US005132202A

United States Patent [19]

Nishijima et al.

[11] Patent Number: 5,132,202

[45] Date of Patent: Jul. 21, 1992

[54] SILVER HALIDE COLOR PHOTOGRAPHIC LIGHT-SENSITIVE MATERIAL

[75] Inventors: Toyoki Nishijima; Masaki Tanji, both of Odawara, Japan

[73] Assignee: Konica Corporation, Tokyo, Japan

[21] Appl. No.: 575,419

[22] Filed: Aug. 30, 1990

[30] Foreign Application Priority Data

Sep. 4, 1989 [JP] Japan ..... 1-228760
Nov. 21, 1989 [JP] Japan ..... 1-302812

[51] Int. Cl.[5] ..... G03C 7/38
[52] U.S. Cl. ..... 430/551; 430/372
[58] Field of Search ..... 430/551, 372

[56] References Cited

U.S. PATENT DOCUMENTS

| | | | |
|---|---|---|---|
| 4,174,220 | 11/1979 | Taguchi et al. | 430/551 |
| 4,178,184 | 12/1979 | Taguchi et al. | 430/551 |
| 4,588,679 | 5/1986 | Furutachi | 430/551 |
| 4,623,617 | 11/1986 | Kaneko et al. | 430/551 |
| 4,675,275 | 6/1987 | Nishijima et al. | 430/551 |
| 4,814,262 | 3/1989 | Sagita et al. | 430/551 |
| 4,863,842 | 9/1989 | Kaneko et al. | 430/551 |
| 4,906,559 | 3/1990 | Nishijima et al. | 430/551 |
| 4,912,027 | 3/1990 | Nishijima et al. | 430/551 |
| 4,931,382 | 6/1990 | Morigaki et al. | 430/551 |
| 4,973,546 | 11/1990 | Kaneko et al. | 430/551 |

*Primary Examiner*—Richard L. Schilling
*Attorney, Agent, or Firm*—Jordan B. Bierman

[57] ABSTRACT

A silver halide color photographic light-sensitive material having an improved light-fastness of magenta dye image is disclosed. The photographic material has a silver halide emulsion layer containing a magenta coupler represented by the following formula [I], a compound by the following formula [II] and a compound represented by the following formula [III]:

[I]

[II]

[III]

7 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, particularly to a silver halide color photographic light-sensitive material having an improved light-fastness of magenta dye images.

BACKGROUND OF THE INVENTION

In the art of silver halide color photographic light-sensitive material (hereinafter referred to as a color photographic material), various pyrazoloazole-type magenta couplers have been developed for the purpose of reducing the unwanted secondary absorption in the vicinity of 430 nm that is common in conventional dyes formed from 5-pyrazolone-type magenta couplers. Examples of them can be seen in U.S. Pat. No. 3,725,067, British Patent No. 1,252,418, Research Disclosure Nos. 24220, 24230, 24531, 24626 and Japanese Patent Publication Open to Public Inspection No. 162548/1984 (hereinafter referred to as Japanese Patent O.P.I. Publication).

Dyes formed from these pyrazoloazole-type magenta couplers possess advantages over the 5-pyrazolone-derived dyes in having a far smaller secondary absorption near 430 nm, a better color reproducibility and a less yellowing (Y-stain) in a non-colored portion caused by exposure to light, heat and moisture.

However, magenta dyes formed from these couples are less light-fast and liable to cause decoloration when exposed to light, and thus heavily deteriorate performance of a color photographic material, especially that of a color photographic material for print.

One technique was proposed in Japanese Patent O.P.I. Publication 125732/1984 to improve the light-fastness of magenta dye images by using a phenol-type compound or a phenylether-type compound together with a 1H-pyrazolo[5,1-c]-1,2,4-triazole magenta coupler.

This technique, however, was still insufficient in preventing color fading of magenta dye images caused by exposure to light. And there have been proposed various combinations of antifading agents to improve the light-fastness.

For example, Japanese Patent O.P.I. Publication No. 246053/1987 discloses a combination of an amine-type antifading agent and a phenol-type antifading agent. Though the light-fastness can be improved to some extent by this method, it is still insufficient, besides its tendency to cause an increased yellowing and deterioration of color tone.

Japanese Patent O.P.I. Publication No. 180366/1987 describes a combination of a hindered phenol type antifading agent and a hydroquinone type compound, but the effect of this method is poor and the use of a hydroquinone type compound in a large amount tends to hinder color forming property.

SUMMARY OF THE INVENTION

The object of the invention is to provide a color photographic material capable of forming magenta dye images with a substantially improved light-fastness, without degrading color tone and color forming property.

Through an intensive study, the present inventors found that the light-fastness of a dye image formed from a pyrazoloazole-type magenta coupler can be improved by employing a specific phenylether-type compound and a specific phenol derivative. Thus, the object of the invention was attained by a color photographic material having a support and provided thereon, at least one silver halide emulsion layer containing at least one of the compounds represented by the following General Formula [I], at least one of the compounds represented by the following General Formula [II] and at least one of the compounds represented by the following General Formula [III].

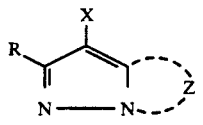

General Formula [I]

wherein Z represents a nonmetallic atomic group necessary for forming a nitrogen-containing heterocycle which may contain a substituent; X represents a hydrogen atom or a group capable of being split off upon reaction with an oxidation product of a developing agent; and R represents a hydrogen atom or a substituent.

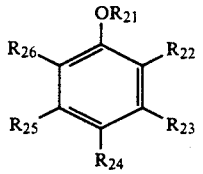

General Formula [II]

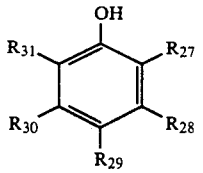

General Formula [III]

In General Formula [II], $R_{21}$ represents an alkyl group or a trialkylsilyl group; $R_{22}$, $R_{23}$, $R_{24}$, $R_{25}$, and $R_{26}$ independently represent a hydrogen atom, an alkyl group, an alkoxy group, an aryl group, an aryloxy group, an alkenyl group, an alkenyloxy group, an acylamino group, a halogen atom, an alkylthio group, an arylthio group, an alkoxycarbonyl group, an acyloxy group, an acyl group or a sulfonamide group; and two groups among those represented by $R_{21}$ through $R_{26}$ may bond with each other to form a 5- or 6-membered ring. In General Formula (III), $R_{27}$ through $R_{31}$ are the same as those defined for $R_{22}$ through $R_{26}$ in General Formula (II), provided that $R_{27}$ and $R_{31}$ are not alkyl groups concurrently.

DETAILED DESCRIPTION OF THE INVENTION

The present invention is described in detail hereunder.

In General Formula [I], the substituent represented by R is not particularly limited, but is typically one of the following groups; namely, alkyl, aryl, anilino, acylamino, sulfonamide, alkylthio, arylthio, alkenyl, and cycloalkyl. Other examples include a halogen atom; cycloalkenyl, alkynyl, heterocyclic, sulfonyl, sulfinyl, phosphonyl, acyl, carbamoyl, sulfamoyl, cyano, alkoxy, aryloxy, heterocyclicoxy, siloxy, acyloxy, carbamoyloxy, amino, alkylamino, imide, ureido, sulfamoylamino, alkoxycarbonylamino, aryloxycarbonylamino, alkoxycarbonyl, aryloxycarbonyl, and heterocyclicthio groups; and spiro-compound residues and bridged hydrocarbon residues.

The alkyl group represented by R has preferably 1 to 32 carbon atoms, and may be linear or branched; the aryl group is preferably a phenyl group; the acylamino group includes alkylcarbonylamino and arylcarbonylamino groups; the sulfonamide group includes alkylsulfonylamino and arylsulfonylamino groups; the alkyl and aryl components in the alkylthio and arylthio groups are the same as the above alkyl and aryl groups represented by R; the alkenyl group has preferably 2 to 32 carbon atoms and may be linear or branched; the cycloalkyl group has desirably 3 to 12, more desirably 5 to 7 carbon atoms; the cycloalkenyl group has desirably 3 to 12, more desirably 5 to 7 carbon atoms; the sulfonyl group includes alkylsulfonyl and arylsulfonyl groups; the sulfinyl group includes alkylsulfinyl and arylsulfinyl groups; the phosphonyl group includes alkylphosphonyl and alkoxyphosphonyl, aryloxyphosphonyl and arylphosphonyl groups; the acyl group includes alkylcarbonyl and arylcarbonyl groups; the carbamoyl group includes alkylcarbamoyl and arylcarbamoyl groups; the sulfamoyl group includes alkylsulfamoyl and arylsulfamoyl groups; the acyloxy group includes alkylcarbonyloxy and arylcarbonyloxy groups; the carbamoyloxy group includes alkylcarbamoyl and arylcarbamoyl groups; the ureido group includes alkylureido and arylureido groups; the sulfamoylamino group includes alkylsulfamoylamino and arylsulfamoylamino groups; the heterocyclic group is preferably a 5- to 7-membered ring such as 2-furyl, 2-thienyl, 2-pyrimidinyl and 2-benzothiazolyl groups; the heterocyclicoxy group is preferably a 5- to 7-membered ring such as 3,4,5,6-tetrahydropyranyl-2-oxy and 1-phenyltetrazole-5-oxy; the heterocyclicthio group is desirably a 5- to 7-membered ring such as 2-pyridylthio, 2-benzothiazolylthio and 2,4-diphenoxy-1,3,5-triazole-6-thio; the siloxy group includes trimethylsiloxy, triethylsiloxy and dimethylbutylsiloxy groups; the imide group includes succinimide, 3-heptadecyl succinimide, phthalimide and gultarimide; the spiro-compound residue includes spiro[3,3]heptane-1-yl; and the bridged hydrocarbon residue includes bicyclo[2,2,1]heptane-1-yl, tricyclo[3,3,1,1$^{3,7}$]decane-1-yl and 7,7-dimethylbicyclo[2,2,1]heptane-1-yl.

The group that -s represented by X and capable of being split off upon reaction with an oxidation product of a developing agent includes a halogen atom, alkoxy, aryloxy, heterocyclicoxy, acyloxy, sulfonyloxy, alkoxycarbonyloxy, aryloxycarbonyl, alkyloxalyloxy, alkoxyoxalyloxy, alkylthio, arylthio, heterocyclicthio, alkyloxythiocarbonylthio, acylamino, sulfonamide, nitorogen-containing heterocycle having a bonding site on N, alkyloxycarbonylamino, aryloxycarbonylamino and carboxyl groups, and a group represented by:

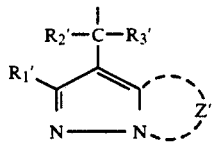

wherein $R_1'$ and Z' are the same as those defined for R and Z in General Formula [I]; $R_2'$ and $R_3'$ independently represent a hydrogen atom, an aryl group, an alkyl group or a heterocyclic group. Among the above groups represented by X, desirable one is a halogen atom, especially a chlorine atom.

The nitrogen-containing heterocycle formed by Z or Z' includes a pyrazole ring, an imidazole ring, a triazole ring and a tertazole ring, and the substituent which said heterocycles may have includes the groups specified above for R.

Desirable one among those represented by General Formula [I] is represented by the following Formula [I']:

Formula [I']

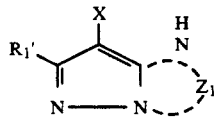

wherein $R_1$, X and $Z_1$ are the same as those defined for R, X and Z in General Formula [I].

Accordingly, the compounds represented by General Formula [I] are expressed more specifically by the following Formulas:

Formula [IA]

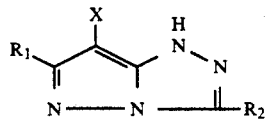

Formula [IB]

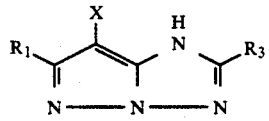

Formula [IC]

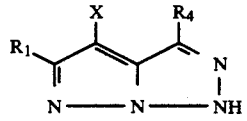

Formula [ID]

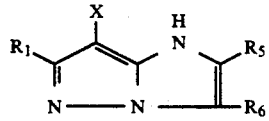

Formula [IE]

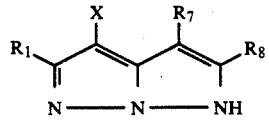

-continued

Formula [IF]

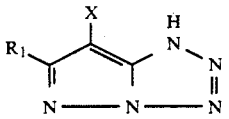

In the above Formulas [IA] through [IF], $R_1$ through $R_8$ and X are the same as defined for R and X in General Formula [I].

Among the magenta couplers represented by Formulas [IA] through [IF], the most desirable one is that represented by Formula [IA].

Of the substituents R and $R_1$ on the above heterocycles, the most desirable one is that represented by the following Formula [Ia]:

Formula [Ia]

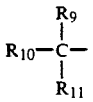

wherein $R_9$, $R_{10}$ and $R_{11}$ are the same as those defined for R in General Formula [I]. Two of $R_9$, $R_{10}$ and $R_{11}$ —$R_9$ and R10, for example,—may bond with each other to form a saturated or unsaturated ring (e.g. a cycloalkane, cycloalkene or heterocycle), and further $R_{11}$ may link with this ring to form a bridged hydrocarbon residue.

With Formula [Ia], it is desirable (i) that at least two of $R_9$ through $R_{11}$ are alkyl groups and (ii) that one of $R_9$ through $R_{11}$ is a hydrogen atom and the other two link with each other to form a cycloalkyl moiety in conjunction with the root carbon atom.

Further, in the above case (i), it is more desirable that two of $R_9$ through $R_{11}$ are alkyl groups and the remaining one is a hydrogen atom or an alkyl group.

As the substituent which may be held by a ring formed by Z in General Formula [I] and a ring formed by $Z_1$ in Formula [I'], and as any of R2 through R8 in Formulas [IA] through [IF], those represented by the following Formula [Ib] are desirable:

$$-R_{12}-SO_2-R_{13}$$

wherein $R_{12}$ represents an alkylene group, $R_{13}$ represents an alkyl group, a cycloalkyl group or an aryl group.

The alkylene group represented by $R_{12}$ has desirably two or more, more desirably 3 to 6 carbon atoms in the straight chain portion, and may be either straight or branched chain.

The cycloalkyl group represented by $R_{13}$ is desirably a 5- or 6-membered one.

Typical examples of the magenta couplers represented by General Formula [I] are illustrated below.

M-1

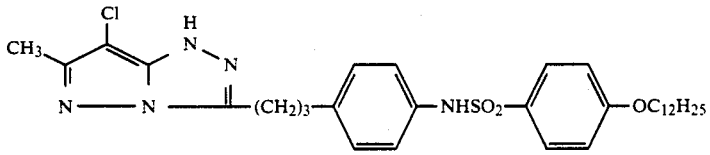

M-2

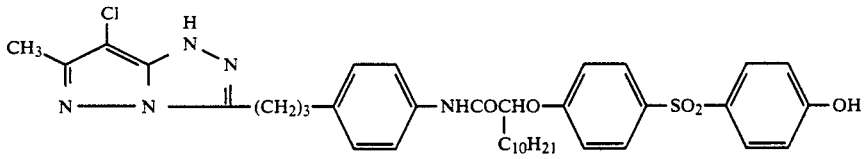

M-3

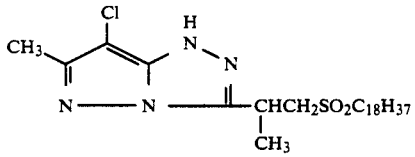

M-4

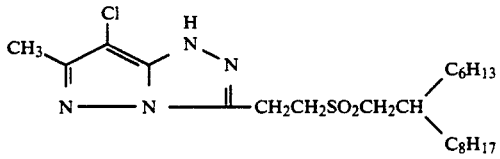

M-5

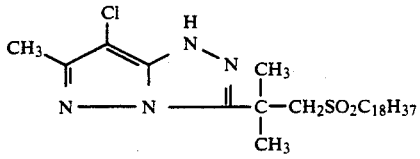

-continued
M-6
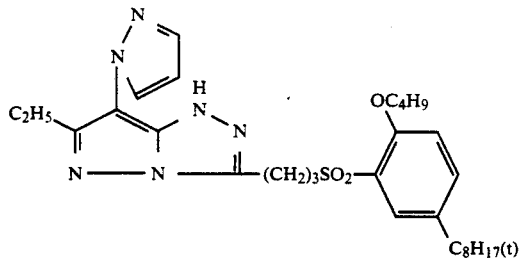
M-7
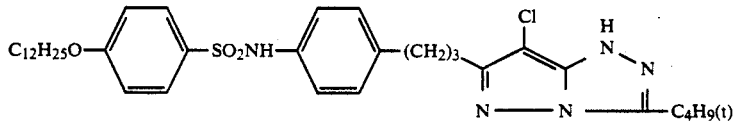
M-8
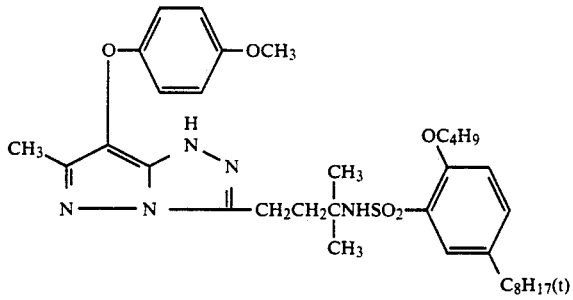
M-9
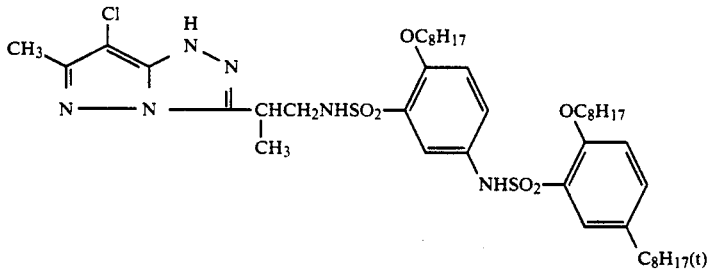
M-10
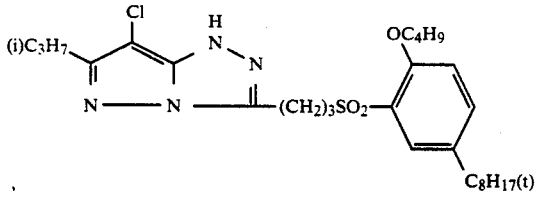
M-11
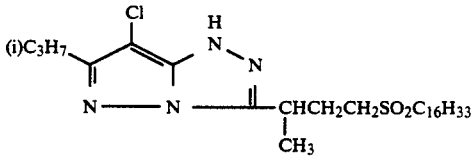
M-12
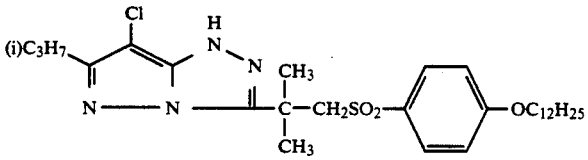

-continued
M-13
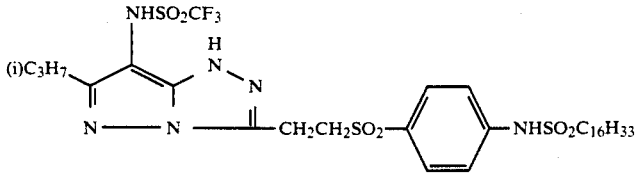
M-14
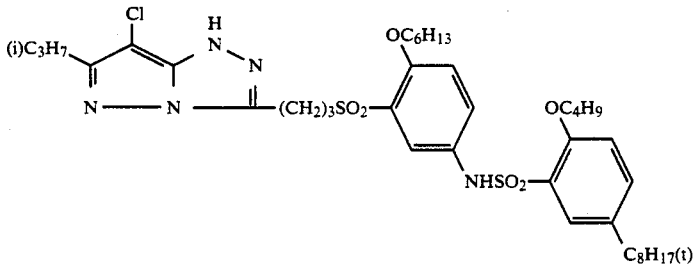
M-15
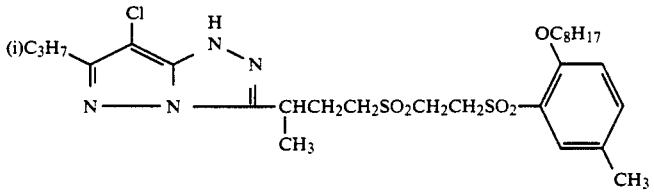
M-16
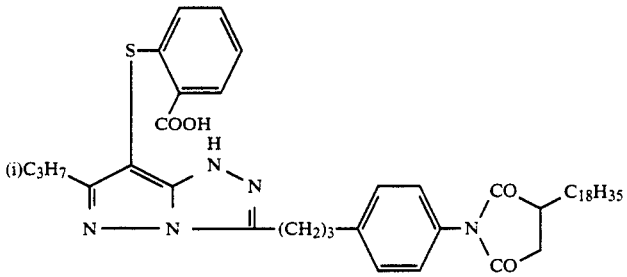
M-17
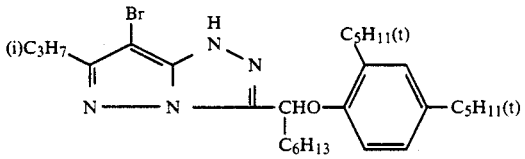
M-18
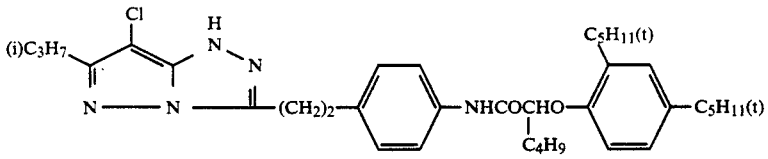
M-19
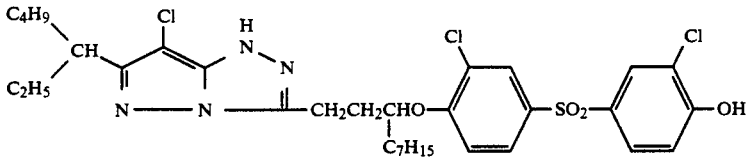
M-20
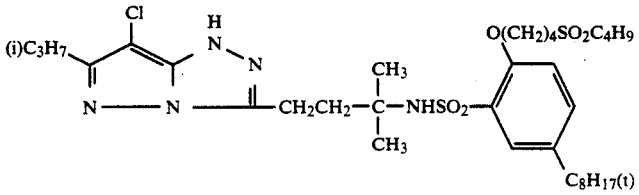

-continued
M-21
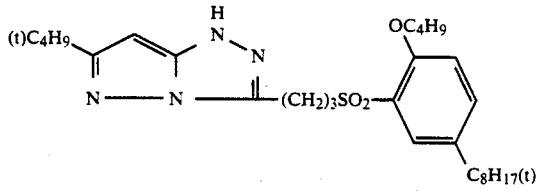
M-22
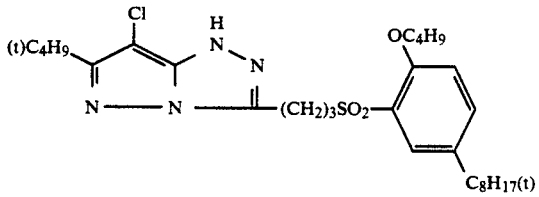
M-23
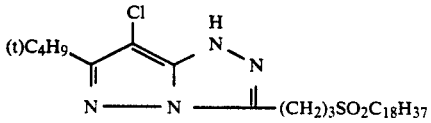
M-24
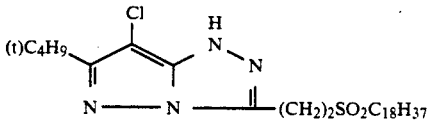
M-25
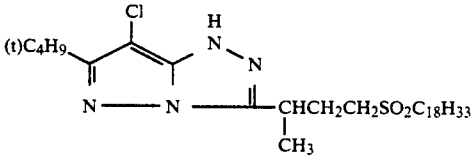
M-26
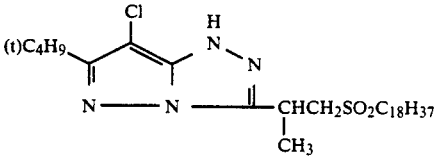
M-27
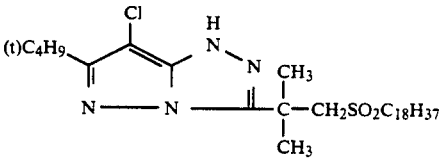
M-28
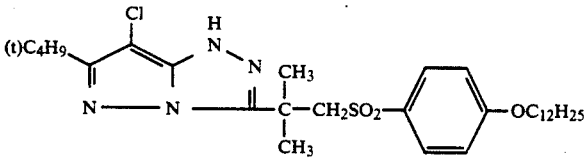
M-29
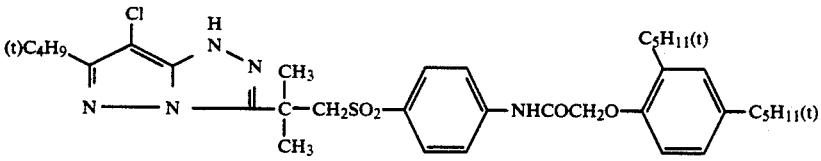
M-30
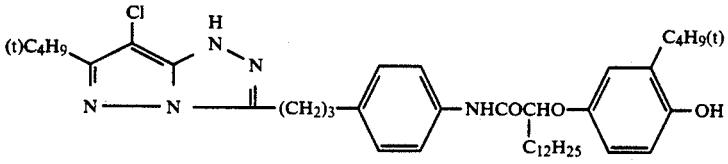

-continued
M-31
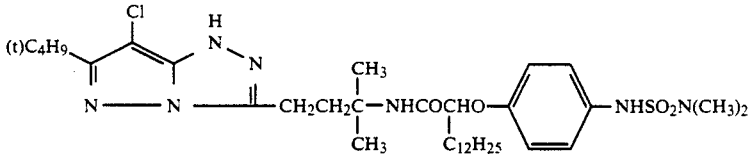
M-32
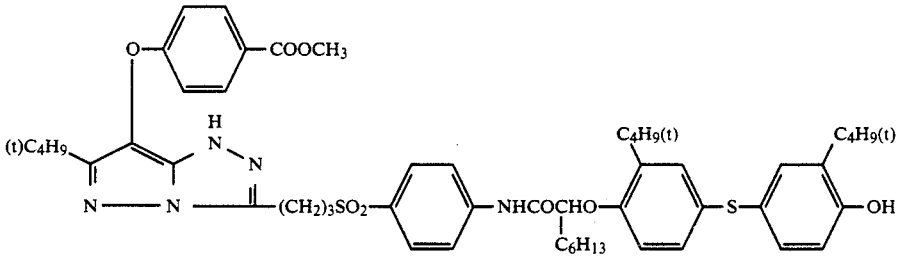
M-33
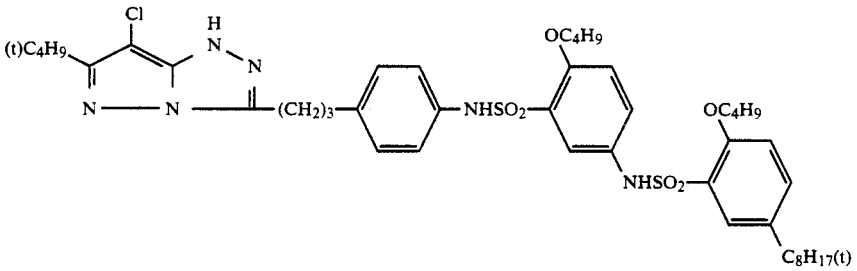
M-34
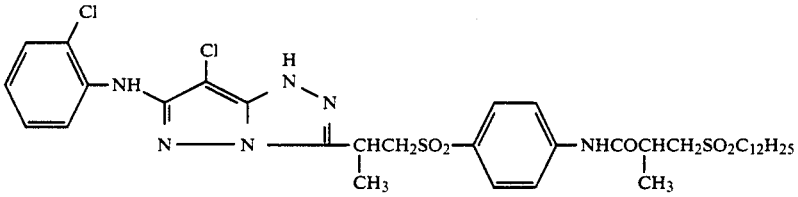
M-35
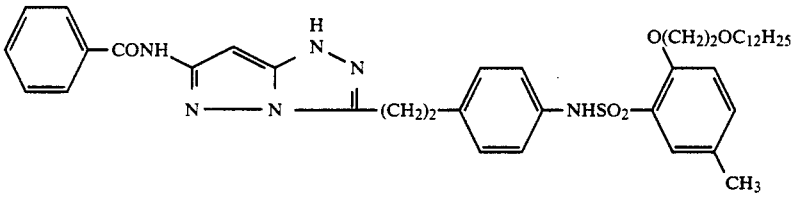
M-36
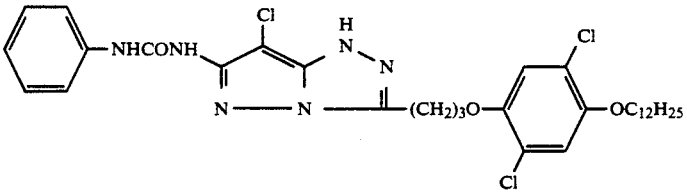
M-37
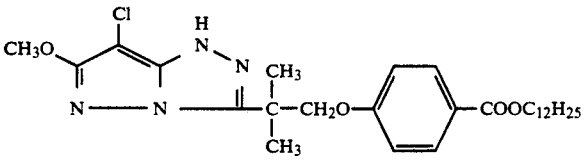

-continued
M-38
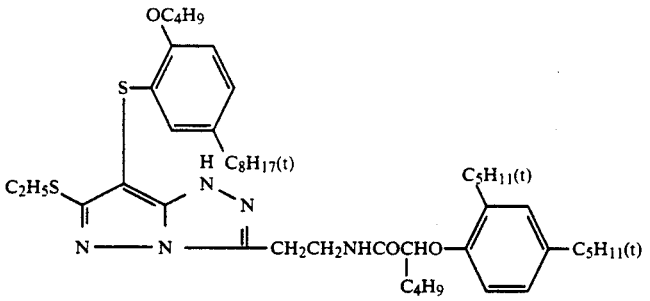
M-39
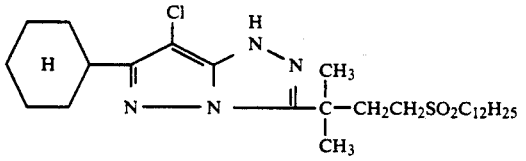
M-40
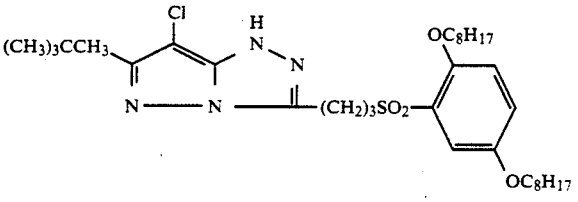
M-41
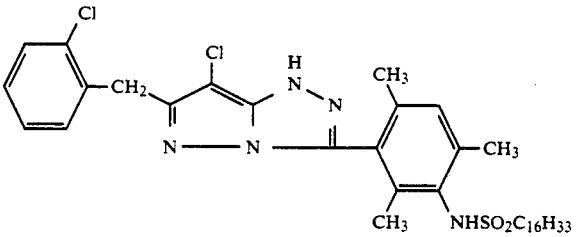
M-42
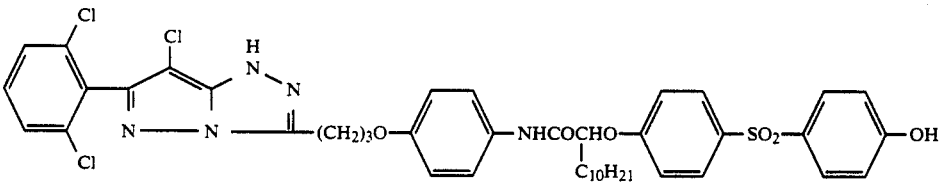
M-43
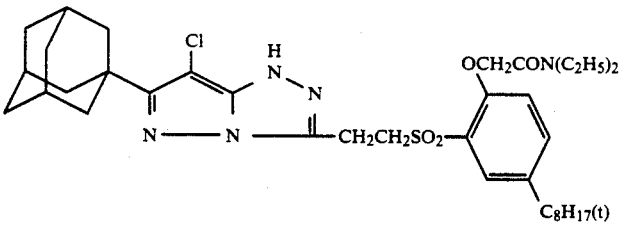
M-44
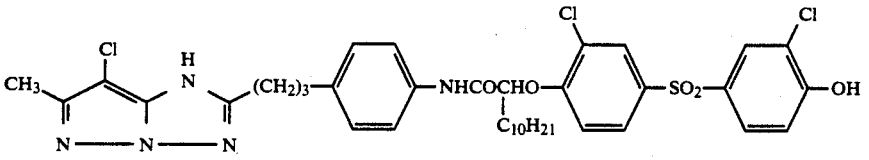
M-45
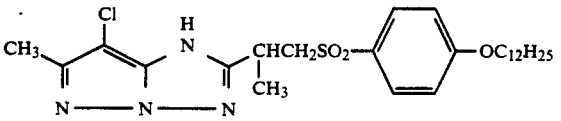

-continued
M-46
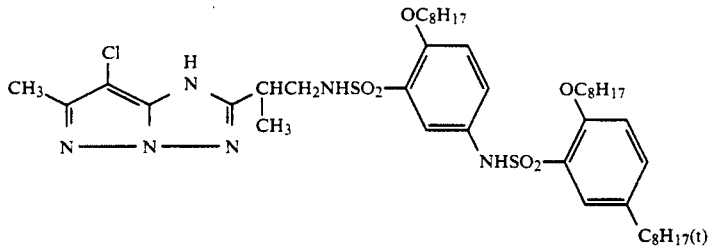
M-17
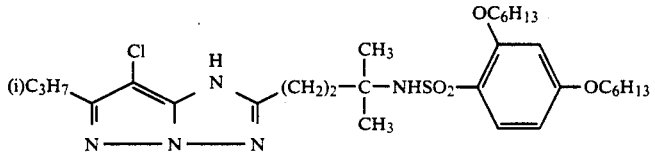
M-48
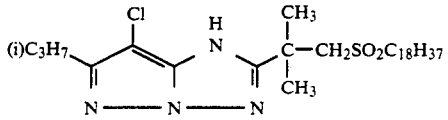
M-49
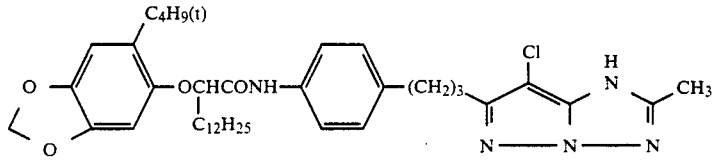
M-50
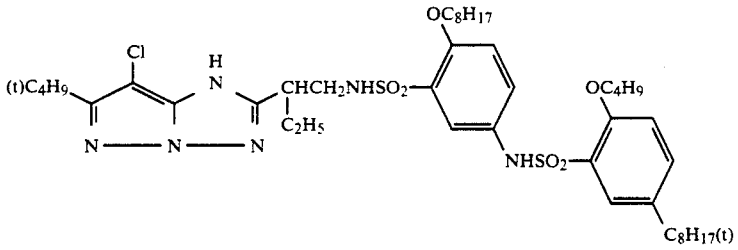
M-51
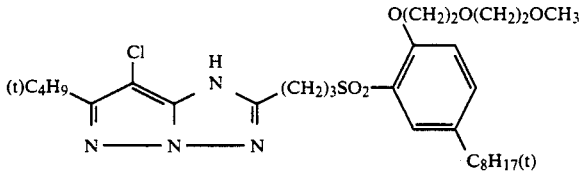
M-52
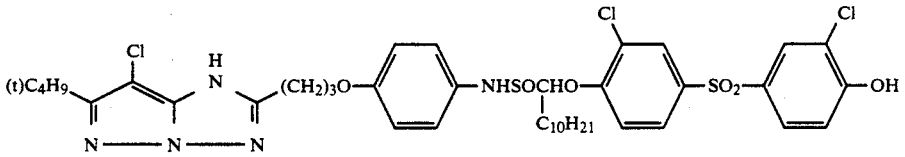
M-53
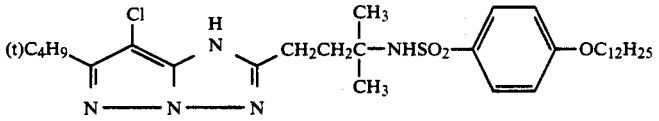
M-54
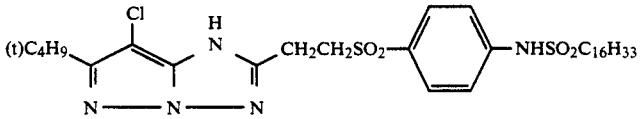

-continued

M-55

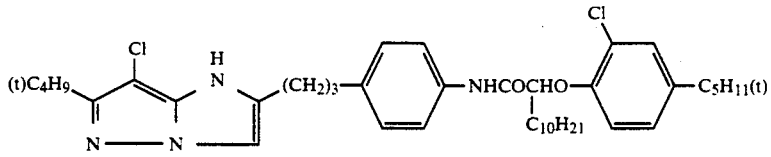

M-56

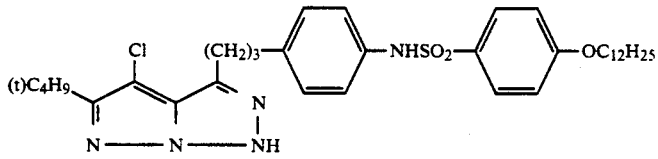

M-57

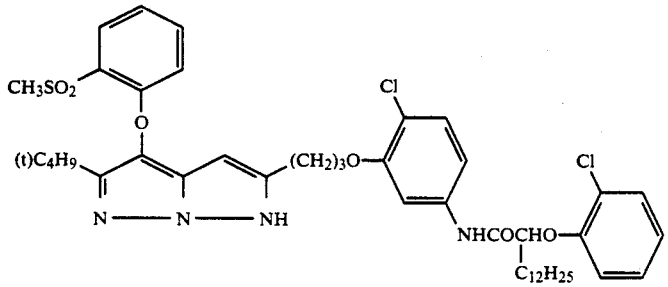

M-58

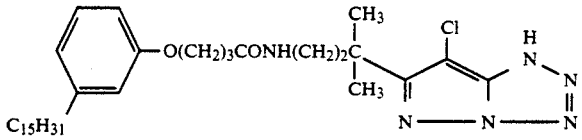

M-59

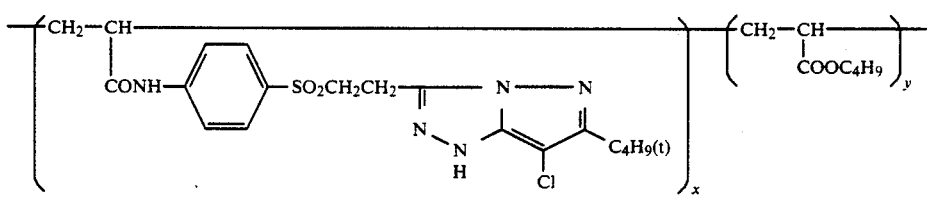

x:y = 50:50

M-60

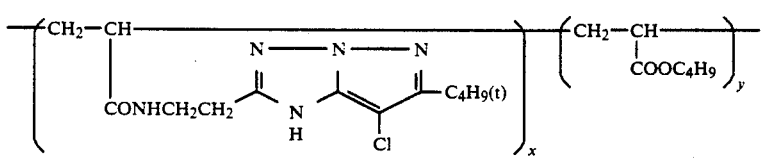

x:y = 50:50

M-61

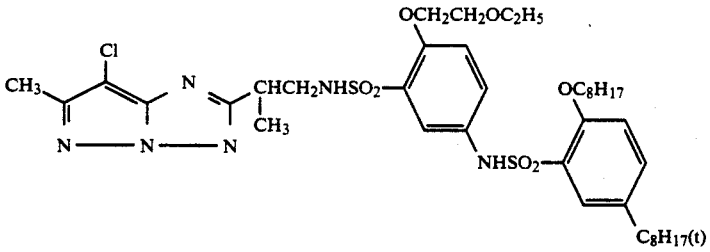

In addition to the above typical examples of the invention, other examples of the compound relating to this invention are those denoted as Nos. 1 through 4, 6, 8 through 17, 19 through 24, 26 through 43, 45 through 59, 61 through 104, 106 through 121, 123 through 162 and 164 through 223 from the upper right column of page 18 to the upper right column of page 32 of Japanese Patent O.P.I. Publication No. 166339/1987. These exemplified couplers can be synthesized by methods disclosed in Journal of the Chemical Society, Parkin I (1977), pp. 2047–2052, U.S. Pat. No. 3,725,067, Japanese Patent O.P.I. Publication Nos. 99437/1984, 42045/1983, 162548/1984, 171956/1984, 33552/1985, 43659/1985, 172982/1985 and 190779/1985.

The couplers of the invention may be used in an amount of $1\times10^{-3}$ mol to 1 mol per mol of silver halide, preferably $1\times10^{-2}$ mol to $8\times10^{-1}$ mol. They can be used in combination with other non-inventive magenta couplers.

High boiling solvents used to disperse a coupler are organic solvents having a boiling point above 150° C., and are not particularly limited by type. And esters such as phthalates, phosphates and benzoates; organic amides; ketones; and hydrocarbons can be used.

Desirable high boiling solvents are those having a dielectric constant below 6.0 at 30° C., the more desirable are those having a dielectric constant of 1.9 to 6.0 and a vapor pressure below 0.5 mmHg at 100° C. Phthalates and phosphates are the best suitable. These high boiling solvents may be used in combination of two or more.

Desirable phthalates in the invention are those represented by the following General Formula [S-1]:

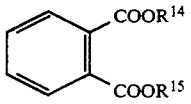

General Formula [S-1]

wherein $R_{14}$ and $R_{15}$ independently represent an alkyl group, an alkenyl group and an aryl group; and the total number of carbon atoms in $R_{14}$ and $R_{15}$ is 12 to 32, desirably 16 to 24, more desirably 18 to 24.

In General Formula [S-1], the alkyl group represented by $R_{14}$ and $R_{15}$ may be either straight or branched chain and includes butyl, pentyl, hexyl, 2-ethylhexyl, 3,5,5-trimethylhexyl, octyl, nonyl, decyl, dodecyl, tetradecyl, hexadecyl and octadecyl; the aryl group includes phenyl and naphthyl; and the alkenyl group includes hexenyl, heptenyl and octadecenyl. These alkyl, alkenyl and aryl groups may have one or more substituents. Substituents contained in the alkyl and alkenyl groups are, for example, a halogen atom, alkoxy, aryl, aryloxy, alkenyl and alkoxycarbonyl group. Substituents in the aryl group are, for example, a halogen atom, alkyl, alkoxy, aryl, aryloxy, alkenyl and alkoxycarbonyl group.

Of them, $R_{14}$ and $R_{15}$ are desirably an alkyl group such as 2-ethylhexyl, 3,5,5-trimethylhexyl, n-octyl and n-nonyl.

Desirable phosphates in the invention are those represented by the following General Formula [S-2]:

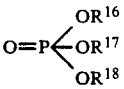

General Formula [S-2]

wherein $R_{16}$, $R_{17}$ and $R_{18}$ independently represent an alkyl group, an alkenyl group or an aryl group; provided that the total number of carbon atoms in $R_{16}$, $R_{17}$ and $R_{18}$ is 24 to 54, preferably 27 to 36.

In General Formula [S-2], the alkyl group represented by $R_{16}$, $R_{17}$ and $R_{18}$ includes butyl, pentyl, hexyl, 2-ethylhexyl, heptyl, 3,5,5-trimethylhexyl, octyl, nonyl, decyl, dodecyl, tetradecyl, hexadecyl, octadecyl and nonadecyl; the aryl group includes phenyl and naphthyl; and the alkenyl group includes hexenyl, heptenyl and octadecenyl.

The above alkyl, alkenyl and aryl groups may have one or more substituents. $R_{16}$, $R_{17}$ and $R_{18}$ are preferably an alkyl group such as 2-ethylhexyl, n-octyl, 3,5,5-trimethylhexyl, n-nonyl, n-decyl, sec-decyl, sec-dodecyl and t-octyl.

Typical examples of the high boiling solvents preferably used in the invention are as follows, but the scope of the invention is not limited to these examples.

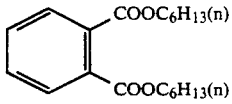

S-1

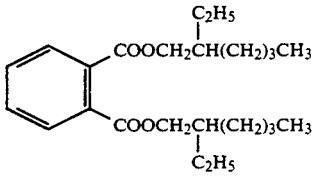

S-2

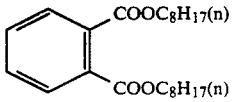

S-3

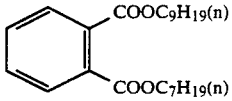

S-4

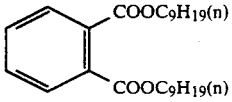

S-5

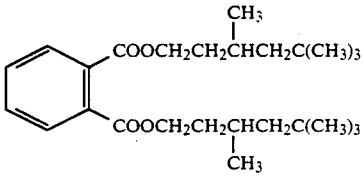

S-6

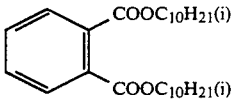

S-7

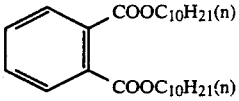

S-8

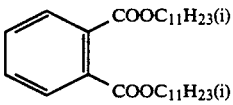

S-9

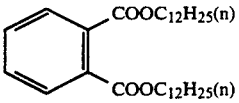

S-10

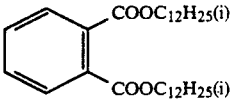

S-11

-continued

S-13

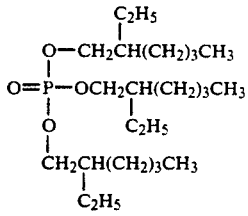

S-13

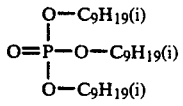

S-14

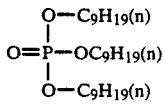

S-15

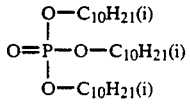

S-16

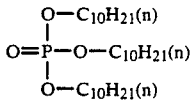

S-17

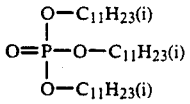

S-18

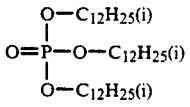

S-19

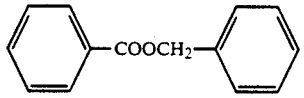

S-20

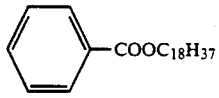

S-21

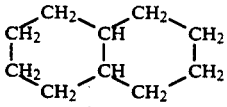

S-22

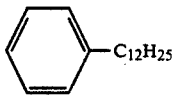

Next, the compounds represented by General Formula [II] and General Formula III] are described below.

In General Formulas [II] and [III], $R_{22}$ through $R_{31}$ independently represent a hydrogen atom, an alkyl group (e.g. methyl, ethyl, octyl and lauryl), an alkoxy group (e.g. methoxy, ethoxy, butoxy and octoxy), an aryl group (e.g. phenyl and naphthyl), an aryloxy group (e.g. phenoxy and naphthoxy), an alkenyl group (e.g. octenyl), an alkenyloxy group (e.g. octenyloxy), an acylamino group (e.g. acetylamino, palmitylamino and benzylamino), a halogen atom (e.g. chlorine and bromine), an alkylthio group (e.g. octylthio and laurylthio), an arylthio group (e.g. phenylthio), an alkoxycarbonyl group (e.g. methoxycarbonyl, ethoxycarbonyl and hexadecyloxycarbonyl), an acyloxy group (e.g. acetyloxy and benzyloxy), an acyl group (e.g. acetyl, valeryl, stearyl and benzyl) and a sulfonamide group (e.g. octylsulfonamide and laurylsulfonamide).

Two of the groups represented by $R_{21}$ through $R_{26}$ or $R_{27}$ through $R_{31}$ may link to form a 5- or 6-membered ring (e.g. indane, spiroindane, chroman or spirochroman). $R_{23}$ and $R_{25}$ in General Formula [II] are preferably some group other than alkoxy group. Further, $R_{27}$ and $R_{31}$ in General Formula [III] are not alkyl goups concurrently.

Of the compounds represented by General Formula [II], desirable ones are specifically represented by the following Formula [II A] or [II B]:

Formula [II A]

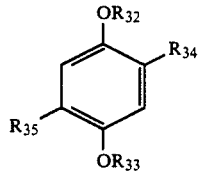

wherein $R_{32}$ through $R_{35}$ independently represent an alkyl group.

Formula [II B]

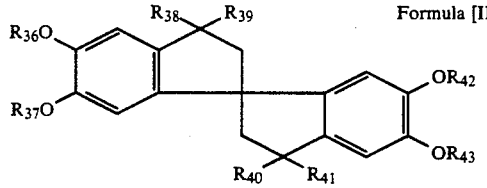

wherein $R_{36}$ through $R_{43}$ independently represent an alkyl group.

The compounds expressed by Formula [II A] are more desirable than those expressed by Formula [II B], and the most desirable ones are those represented by Formula (II A) in which both $R_{32}$ and $R_{33}$ are alkyl groups having five or less carbon atoms.

Among the compounds represented by General Formula [III], desirable ones are specifically represented by Formula [III A], and more desirable ones by Formula [III B]:

Formula [III A]

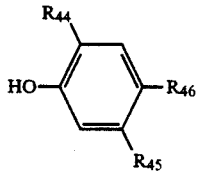

wherein $R_{44}$, $R_{45}$ and $R_{46}$ independently represent an alkyl group.

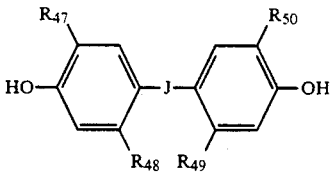
Formula [III B]
wherein $R_{47}$, $R_{48}$, $R_{49}$ and $R_{50}$ independently represent an alkyl group, and J represents an alkylene group which may have a branched chain.
Typical examples of antifading agents represented by General Formula [II] and [III] are shown below.
II-1
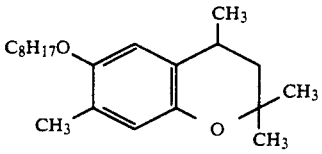
II-2
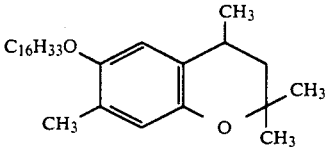
II-3
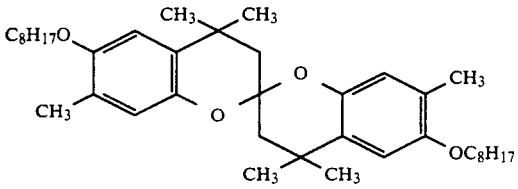
II-4
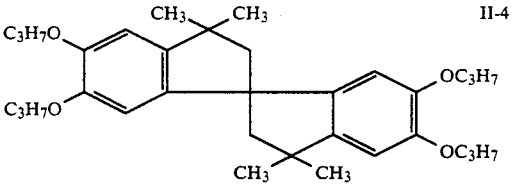
II-5
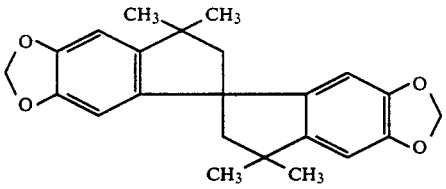
II-6
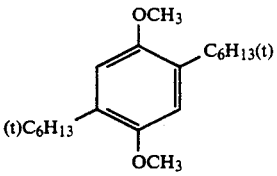
II-7
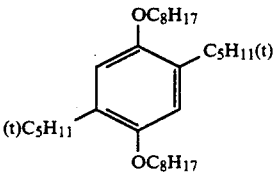
-continued
II-8
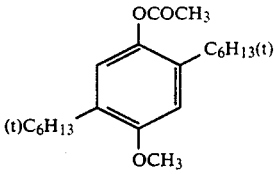
II-9
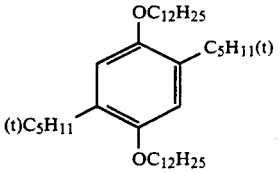
II-10
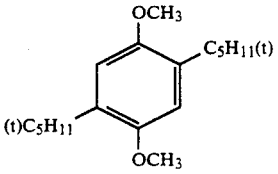
II-11
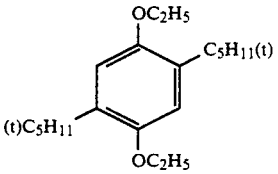
II-12
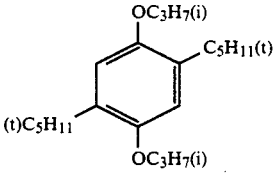
II-13
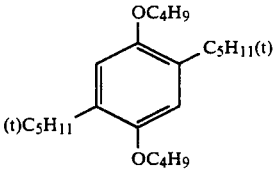
II-14
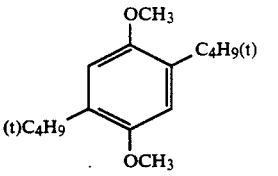
II-15
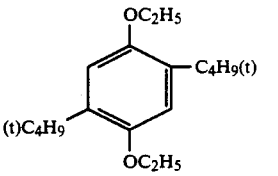
II-16
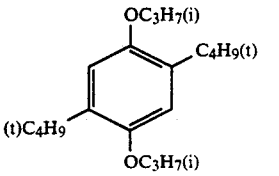

-continued
II-17
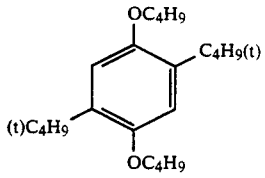
II-18
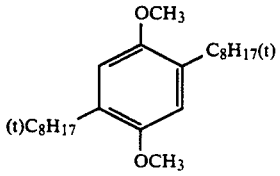
II-19
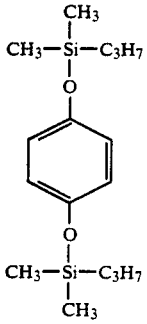
III-1
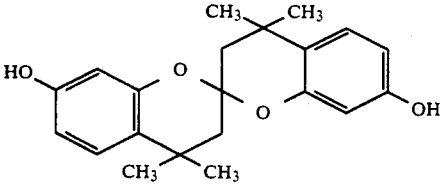
III-2
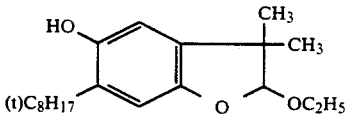
III-3
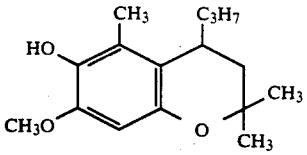
III-4
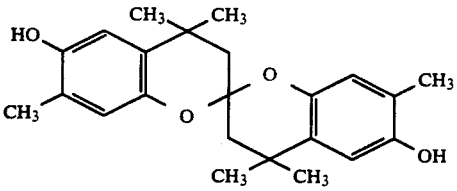
III-5
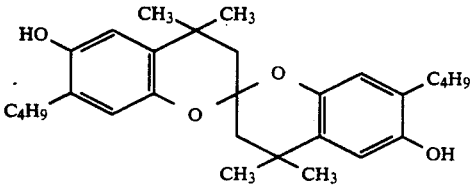
-continued
III-6
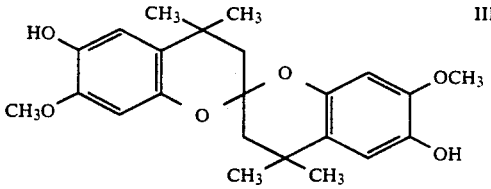
III-7
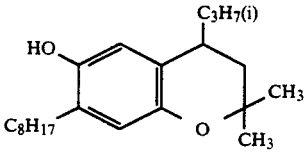
III-8
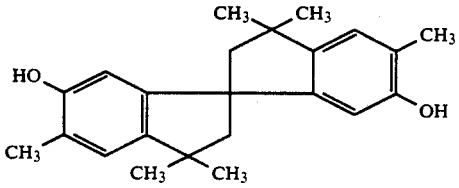
III-9
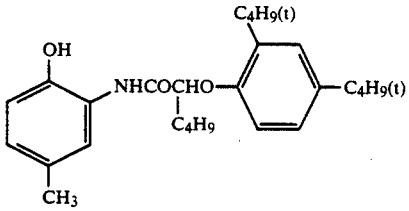
III-10
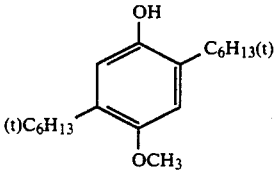
III-11
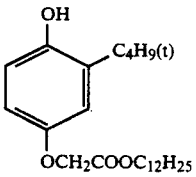
III-12
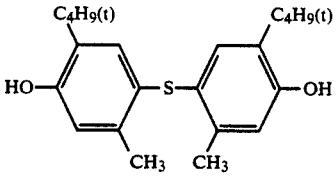
III-13
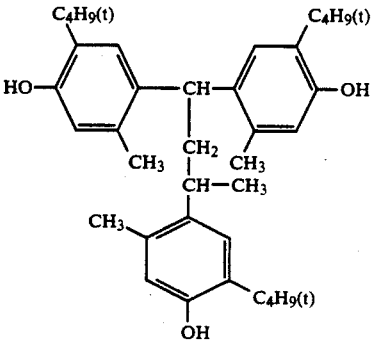

-continued

III-14

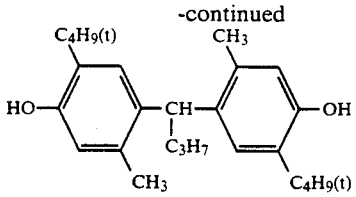

III-15

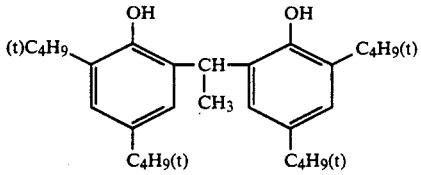

III-16

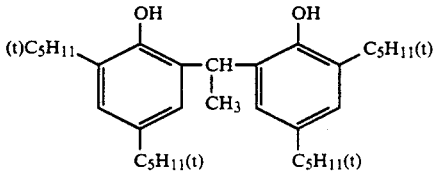

A silver halide emulsion used in a color photographic material of the invention may be any of those silver bromide, silver iodobromide, silver iodochloride, silver bromochloride and silver chloride which are used in a conventional silver halide emulsion. Desirable one is that containing 90 mol % or more of silver chloride. Also, a silver bromide content of 10 mol % or less and a silver iodide content of 0.5 mol % or less are desirable. More desirable one is a silver bromochloride containing 0.1 to 2 mol % of silver bromide.

Silver halide grains with such a high silver chloride content may be used singly or together with other silver halide grains of different composition, or mixed with silver halide grains containing 10 mol % or less of silver chloride.

Further, in a silver halide emulsion layer which contains silver halide grains containing 90 mol % or more of silver chloride, the silver halide grains having a silver chloride content of 90 mol % or more amount to 60 wt % or more, preferably 80 wt % or more, of the total silver halide grains in the said emulsion layer.

Composition of a silver halide grain may be uniform throughout the grain or different from the inner portion to the outer portion of the grain. In case the composition differs from the inner portion to the outer portion, it may change continuously or discontinuously.

The size of the silver halide grain is not particularly limited, but in consideration of rapid processability, sensitivity and other photographic properties, it is desirably 0.2 to 1.6 μm, more desirably 0.25 to 1.2 μm. The said grain size can be measured by any of various methods used in the photographic art. Typical methods are described in "Particle-Size Measurement" (by R. P. Loveland, A.S.T.M. Symposium on Light Mycroscopy, 1955, pp. 94–122) and "The Theory of the Photographic Process" (by C. E. K. Mees & T. H. James, 3rd Edition, 1966, MacMillan Publishing Co., Chapter 2). The grain size can be determined based on projected areas of grains or approximate values of grain diameters. If the grains are virtually uniform in shape, the grain size distribution can be expressed fairly precisely with a diameter or a projected area.

The grain size distribution of the silver halide grains may be either multidispersed or monodispersed one. The desirable are monodispersed silver halide grains having a variation coefficient of not more than 0.22, especially not more than 0.15. The variation coefficient indicates a range of the grain size distribution and is defined by the following expressions.

$$\text{Variation coefficient } (S/\bar{r}) = \frac{\text{Standard deviation of grain size distribution}}{\text{Average grain size}}$$

$$\text{Standard deviation of grain size distribution } (S) = \sqrt{\frac{\Sigma(\bar{r} - ri)^2 ni}{\Sigma ni}}$$

$$\text{Average grain size } (\bar{r}) = \frac{\Sigma niri}{\Sigma ni}$$

In the above expressions, ri represents a size of individual grains, and ni represents the number of grains. The term "grain size" used herein means a diameter for spherical silver halide grains, or a diameter of a circular image converted from a projected image for cubical grains or those having any shape other than sphere.

The silver halide grains used in the color photographic material of the invention may be prepared by any of the acid method, neutral method and ammonium method. These grains may be grown in one step or from seed grains prepared in advance. The method for forming the seed grains and one for growing the grains may be the same or different from each other.

As a method for reacting a soluble silver salt with a soluble halogen salt, any of the normal precipitation method, reverse precipitation method and double-jet precipitation method, and a combination of these methods may be used, but the double-jet precipitation method is preferable. The pAg-controlled double-jet method, one modification of the double-jet precipitation method, disclosed in Japanese Patent O.P.I. Publication No. 48521/1979 is also applicable.

If necessary, a solvent for silver halide such as thioether may be employed. Further, a mercapto-group-containing compound, nitrogen-containing heterocyclic compound or sensitizing dye may be added during or after the formation of silver halide grains.

The shape of silver halide grains can be freely selected. A preferred example is a cubical grain having (100) crystal faces. Further, octahedral, tetradecahedral or dodecahedral grains may be prepared according to methods described in U.S. Pat. Nos. 4,183,756, 4,225,666, Japanese Patent O.P.I. Publication No. 26589/1980, Japanese Patent Examined Publication No. 42737/1980 and The Journal of Photographic Science, (1973) Vol. 21, p. 39, thereby resulting silver halide grains may be used to practice the invention. Grains having twin plains can be also employed. The silver halide grains of the invention may be uniform in shape or a mixture of various shapes.

In the course of forming and/or growing silver halide grains, metal ions may be incorporated into the interior and/or onto the surface of the grains by adding a cadmium salt, zinc salt, lead salt, thallium salt, iridium salt or its complex salt, rhodium salt or its complex salt, or iron salt or its complex salt. Moreover, reduction-sensitized nuclei may be formed inside and/or on the surface of the grains by subjecting the grains to an adequate reducing environment.

After the silver halide grains of the invention have been grown, excessive soluble salts may be removed or left unremoved from an emulsion containing the said grains. Such a desalination can be carried out according to a method described in Research Disclosure No. 17643.

The silver halide grains of the invention may be grains in which latent images are formed primarily on the surface, or those in which latent images are formed primarily at the interior thereof. But preferable grains are those in which latent images are formed primarily on the surface. Further, the silver halide grains are chemically sensitized by a conventional method.

The silver halide grains of internal latent image type may be any of silver bromide, silver chloride, silver chlorobromide, silver chloroiodide, silver iodobromide and silver bromochloroiodide; provided that grains of these silver halides form latent images primarily at the inside thereof and contain the most part of sensitivity specks at the inside thereof.

Emulsions containing the internal latent image forming silver halide grains usable in the invention can be prepared by various methods. Examples of such an emulsion include a conversion type silver halide emulsion described in U.S. Pat. No. 2,592,250; an emulsion containing internally chemically-sensitized silver halide grains described in U.S. Pat. Nos. 3,206,316, 3,317,322 and 3,367,778; an emulsion containing silver halide grains having a polyvalent metallic ion therein describer in U.S. Pat. Nos. 3,271,157, 3,447,927 and 3,531,291; an emulsion containing doped silver halide grains whose surface is chemically sensitized to a small extent as described in U.S. Pat. No. 3,761,276; an emulsion containing silver halide grains of a multilayered structure described in Japanese Patent Publication Open to Public Inspection (hereinafter referred to as Japanese Patent O.P.I. Publication) Nos. 8524/1575, 38525/1975 and 2408/1978; and other types of silver halide emulsion described in Japanese Patent O.P.I. Publication Nos. 156614/1977 and 127549/1980.

To form positive images directly on a photographic light-sensitive material comprising of internal latent image type emulsion layers, the light-sensitive material is subjected to imagewise exposure without being fogged in advance and then undergone a fogging treatment to form fogged specks by chemical or optical means, next, the light-sensitive material is subjected to surface development after the fogging treatment and/or while it is performed. The fogging treatment can be carried out by subjecting the light-sensitive material to a full-sized exposure or using a fogging agent which forms fogged specks.

The color photographic material of the invention can provide dye images when exposed and then subjected to a process comprising at least development and desilverization. But, after being exposed, it is preferably subjected to a process comprising color developing and bleach-fixing followed by washing or stabilizing.

In carrying out the color developing, a color developing agent is usually contained in a color developer. However, a portion or the whole of the color developing agent may be contained in a color photographic material to be processed later in either a color developer containing a color developing agent or one that does not contain it.

The color developing agent is an aromatic amine color developing agent that contains an aminophenol derivative or a p-phenylenediamine derivative, preferably a p-phenylenediamine derivative. The said color developing agent may be used as a salt of organic or inorganic acid, such as, hydrochlorides, sulfates, p-toluenesulfonates, sulfites, oxalates and benzenesulfonates.

These compounds are used in an amount of about 0.1 g to about 30 g per liter of color developer, preferably about 1 g to about 15 g per liter of color developer.

Particularly useful primary amine color developing agents are N,N-dialkyl-p-phenylenediamine derivatives, of which alkyl and phenyl groups may be substituted or not. Among them, particularly useful ones are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N-diethylaniline and 4-amino-N-(2-methoxyethyl)-N-ethyl-3-methylaniline-p-toluenesulfonate.

These color developing agents may be used singly or in combination of two or more. And the color developer may contain a conventional alkaline agent such as sodium hydroxide, potassium hydroxide, ammonium hydroxide, sodium carbonate, potassium carbonate, sodium phosphate, sodium metaborate, or borax. Additionally, there may be contained various additives such as an alkali metal halide (e.g. potassium bromide or potassium chloride), development control agent (e.g. citrazinic acid), and preservative (e.g. hydroxylamine, polyethyleneimine, grape sugar, or sulfites such as sodium sulfite and potassium sulfite). Further, various defoamers and surfactants; and methanol, N,N-dimethylformaldehyde, ethylene glycol, diethylene glycol, dimethylsufoxide or benzyl alcohol may be added. In the present invention, however, it is desirable to employ a color developer which does not virtually contain benzyl alcohol and does contain a sulfite of $2\times10^{-2}$ mol/l or less. A more desirable content of sulfite is $1\times10^{-4}$ to $1.7\times10^{-2}$ mol/l, and the most desirable one is $5\times10^{-3}$ to $1\times10^{-2}$ mol/l. The term "does not virtually contain" is intended to mean that the benzyl alcohol content is 0.5 ml/l or less, preferably zero.

The pH of a color developer is usually 7 or more, desirably 9 to 13.

The temperature of a color developing bath is desirably 10° C. to 65° C., more desirably 25° C. to 45° C.

The development time is desirably less than 2 minutes and 30 seconds, more desirably less than 2 minutes.

Developed silver halide color light-sensitive materials are usually bleached concurrently with fixing (bleach-fixing) or separately, but they are preferably processed in a bleach-fixer to carry out bleaching and fixing concurrently. The pH of the bleach-fixer is desirably 4.5 to 6.8, more desirably 4.5 to 6.0.

Desirable bleaching agents used in the bleach-fixer are metal complex salts of an organic acid; more desirable ones are coordinate compounds of aminopolycarboxylic acids, oxalic acid or citric acid with metal ions such as iron, cobalt or copper ions.

As additives to the bleach-fixer, the commonly used are rehalogenating agents such as alkali halides and ammonium halides (e.g. potassium bromide, sodium bromide, sodium chloride and ammonium bromide); metal salts and chelating agents.

Other additives which are optionally used in the bleach-fixer include conventional bleach auxiliaries such as pH buffers including borates, oxalates, acetates, carbonates and phosphates; alkylamines; and polyethylene oxides.

Further, the bleach-fixer may contain one or more of pH buffers comprising sulfites such as ammonium sulfite, potassium sulfite, ammonium bisulfite, potassium bisulfite, sodium bisulfite, ammonium metabisulfite, potassium metabisulfite and sodium metabisulfite; and boric acid, borax, acetic acid, sodium hydroxide, potassium hydroxide, sodium carbonate, potassium carboate, sodium bicarbonate, potassium bicarbonate, sodium acetate and ammonium hydroxide.

EXAMPLES

The following examples further illustrate the various aspects of the invention but are not intended to limit it.

Example 1

A solution dissolving a coupler and a dye image stabilizer according to a specific requirement in a mixture of a high boiling solvent and ethyl acetate was added to an aqueous gelatin solution containing a dispersant, and then the mixture was stirred with an ultrasonic homogenizer. To the resultant emulsion were added a gelatin coating solution and a light-sensitive silver halide emulsion to prepare an emulsion coating solution.

Using a paper support whose one side was laminated with polyethylene and the other side with polyethylene containing titanium dioxide, there were formed on the latter side of the support the layers shown in Table 1 to prepare a multilayered silver halide color photographic light-sensitive material, Sample 1.

The silver halide emulsion used was prepared as follows. [Preparation of Blue-sensitive Silver Halide Emulsion]

To 1000 ml of 2% aqueous gelatin solution kept at 40° C. were added the following Solution A and Solution B over a period of 30 minutes keeping pAg at 6.5 and pH at 3.0. Then, the following Solution C and Solution D were simultaneously added thereto over a period of 180 minutes keeping pAg at 7.3 and pH at 5.5.

During the above process, control of pAg was carried out by the method described in Japanese Patent O.P.I. Publication No. 45437/1984, and that of pH with an aqueous solution of sulfuric acid or sodium hydroxide.

| | |
|---|---|
| Solution A | |
| Sodium chloride | 3.42 g |
| Potassium bromide | 0.03 g |
| Water to make | 200 ml |
| Solution B | |
| Silver nitrate | 10 g |
| Water to make | 200 ml |
| Solution C | |
| Sodium chloride | 102.7 g |
| Potassium bromide | 1.0 g |
| Water to make | 600 ml |
| Solution D | |
| Silver nitrate | 300 g |
| Water to make | 600 ml |

After completion of the addition, the suspension was desalinated with a 5% aqueous solution of DEMOL N made by Kao Atlas Co. and a 20% aqueous solution of magnesium sulfate, and then mixed with an aqueous gelatin solution. Thus, a monodispersed cubical grain emulsion EMP-1 having an average grain size of 0.85 μm, a coefficient of variation ($S/\bar{r}$) of 0.07, and a silver chloride content of 99.5 mol % was obtained.

The emulsion EMP-1 was chemically sensitized at 50° C. for 90 minutes with the following compounds to prepare a blue-sensitive silver halide emulsion Em A.

| | |
|---|---|
| Sodium thiosulfate | 0.8 mg/mol AgX |
| Chloroauric acid | 0.5 mg/mol Agx |
| Stabilizer SB-5 | $6 \times 10^{-4}$ mol/mol AgX |
| Sensitizing dye D-1 | $5 \times 10^{-4}$ mol/mol AgX |

Preparation of Green-sensitive Silver Halide Emulsion

A monodispersed cubical grain emulsion EMP-2 having an average grain size of 0.43 μm, a coefficient of variation ($S/\bar{r}$) of 0.08, and a silver chloride content of 99.5 mol % was prepared in the same manner as in EMP-1, except that the addition time of Solution A and Solution B and that of Solution C and Solution D were changed.

EMP-2 was chemically sensitized at 55° C. for 120 minutes with the following compounds to prepare a green-sensitive silver halide emulsion Em B.

| | |
|---|---|
| Sodium thiosulfate | 1.5 mg/mol AgX |
| Chloroauric acid | 1.0 mg/mol Agx |
| Stabilizer SB-5 | $6 \times 10^{-4}$ mol/mol AgX |
| Sensitizing dye D-2 | $4.0 \times 10^{-4}$ mol/mol AgX |

Preparation of Red-sensitive Silver Halide Emulsion

A monodispersed cubical grain emulsion EMP-3 having an average grain size of 0.50 μm, a coefficient of variation ($S/\bar{r}$) of 0.08, and a silver chloride content of 99.5 mol % was prepared in the same manner as in EMP-1, except that the addition time of Solution A and Solution B and that of Solution C and Solution D were changed.

EMP-3 was chemically sensitized at 60° C. for 90 minutes with the following compounds to prepare a red-sensitive silver halide emulsion Em C.

| | |
|---|---|
| Sodium thiosulfate | 1.8 mg/mol AgX |
| Chloroauric acid | 2.0 mg/mol Agx |
| Stabilizer SB-5 | $6 \times 10^{-4}$ mol/mol AgX |
| Sensitizing dye D-3 | $8.0 \times 10^{-4}$ mol/mol AgX |

D-1

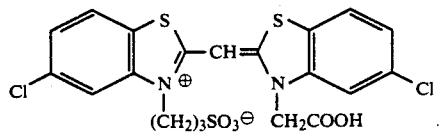

-continued

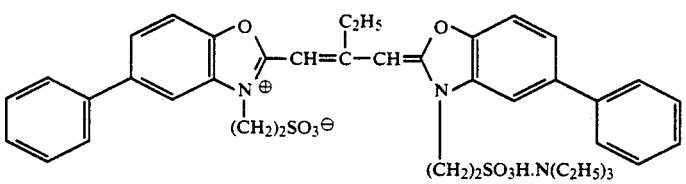

D-2

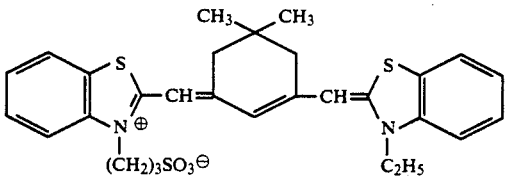

D-3

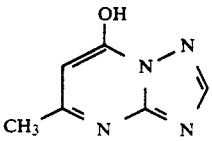

SB-5

TABLE 1

| Layer | Construction | Amount of addition (g/m2) |
|---|---|---|
| 7th layer (Protective layer) | Gelatin | 1.0 |
| 6th layer (ultraviolet ray absorption layer) | Gelatin | 0.6 |
| | Ultraviolet absorbent (UV-1) | 0.2 |
| | Ultraviolet absorbent (UV-2) | 0.2 |
| | Color mixing inhibitor (compound B) | 0.01 |
| | S-5 (DNP) | 0.2 |
| | PVP | 0.03 |
| | Antiirradiation dye (Al-2) | 0.02 |
| 5th layer (red-sensitive layer) | Gelatin | 1.40 |
| | Red-sensitive silver bromochloride emulsion (Em C) in terms of silver | 0.24 |
| | Cyan coupler (C-1) | 0.17 |
| | Cyan coupler (C-2) | 0.25 |
| | S-2 (DOP) | 0.20 |
| | Dye image stabilizer (compound A) | 0.20 |
| | High boiling organic solvent (HB-1) | 0.10 |
| | Color mixing inhibitor (compound B) | 0.01 |
| | DOP | 0.30 |
| 4th layer (ultraviolet ray absorption layer) | Gelatin | 1.30 |
| | Ultraviolet absorbent (UV-1) | 0.40 |
| | Ultraviolet absorbent (UV-2) | 0.40 |

TABLE 1-continued

| Layer | Construction | Amount of addition (g/m2) |
|---|---|---|
| | Color mixing inhibitor (compound B) | 0.03 |
| | DNP | 0.40 |
| 3rd layer (green-sensitive layer) | Gelatin | 1.40 |
| | Green-sensitive silver bromochloride emulsion (Em B) in terms of silver | 0.27 |
| | Magenta coupler (M-1) | 0.35 |
| | DOP | 0.50 |
| | Antiirradiation dye (Al-1) | 0.01 |
| 2nd layer | Gelatin | 1.20 |
| | Color mixing inhibitor (compound B) | 0.12 |
| | S-7 (DIDP) | 0.15 |
| 1st layer (blue-sensitive layer) | Gelatin | 1.30 |
| | Blue-sensitive silver bromochloride emulsion (Em A) in terms of silver | 0.30 |
| | Yellow coupler (Y-1) | 0.80 |
| | Dye image stabilizer (compound A) | 0.30 |
| | Dye image stabilizer (ST-2) | 0.20 |
| | DNP | 0.15 |
| | Color mixing inhibitor (compound B) | 0.02 |
| | DNP | 0.20 |
| Support | Polyethylene laminated paper | |

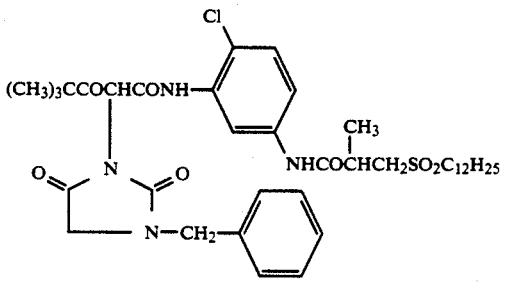

Y-1

-continued
M-1
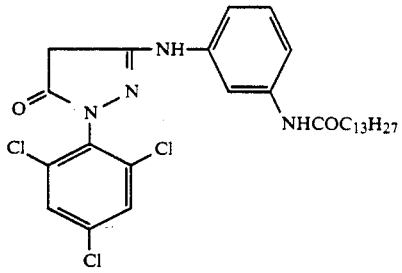
C-1
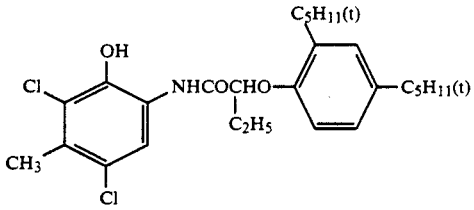
C-2
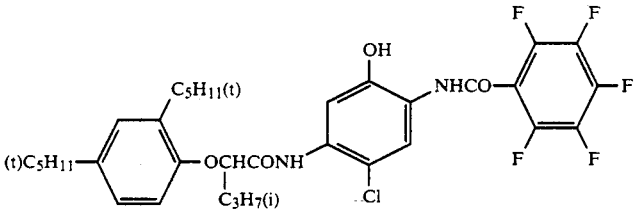
Compound A
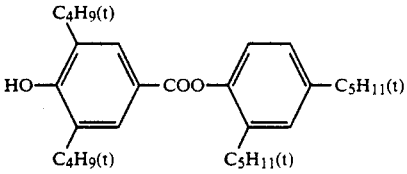
ST-2
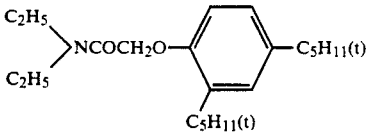
Polyvinylpyrrolidone PVP
UV-1
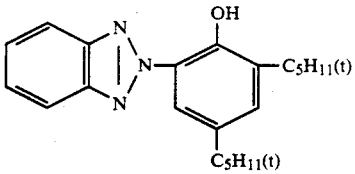
UV-2
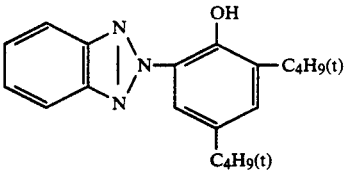
Compound B
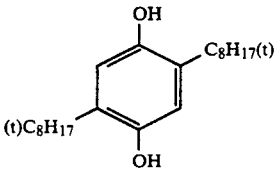

-continued

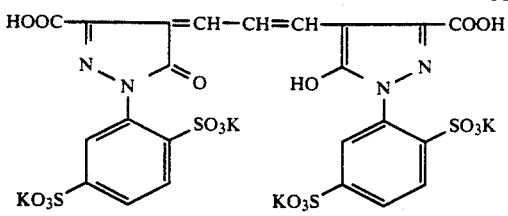

AI-1

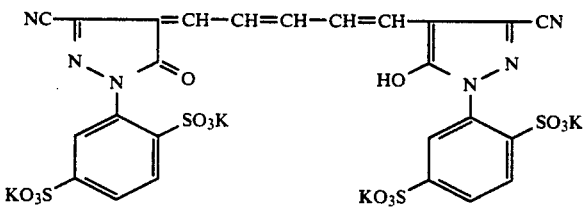

AI-2

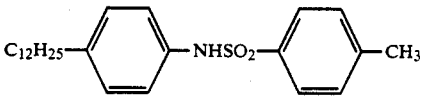

HB-1

Next, a sample whose 3rd layer contains a coupler and a dye-image stabilizer in a combination shown in Table 2 was prepared.

These samples were each exposed to green light through an optical wedge according to a conventional method, and then subjected to the following processing.

| Processing step | Temperature | Time |
|---|---|---|
| Color developing | 35.0 + 0.3° C. | 45 sec |
| Bleach-fixing | 35.0 + 0.5° C. | 45 sec |
| Stabilizing | 30 to 34° C. | 90 sec |
| Drying | 60 to 80° C. | 60 sec |

| Color developer solution | |
|---|---|
| Water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1-1-diphosphonic acid | 1.0 g |
| Ethylenediaminetetraacetic acid | 1.0 g |
| Disodium catechol-3,5-disulfonate | 1.0 g |
| N-ethyl-N-(β-methanesulfonamidoethyl)-3-methyl-4-aminoaniline sulfate | 4.5 g |
| Brightening agent (4,4'-diamino stilbene disulfonate derivative) | 1.0 g |
| Potassium carbonate | 27 g |
| Water to make | 1 l |
| pH was adjusted to 10.10 | |
| **Bleach-fixer solution** | |
| Ammonium ferric ethylenediaminetetraacetate dihydrate | 60 g |
| Ethylenediaminetetraacetate | 3 g |
| Ammonium thiosulfate (70% aqueous solution) | 100 ml |
| Ammonium sulfite (40% aqueous solution) | 27.5 ml |
| Water to make | 1 l |
| pH was adjusted to 5.7 with potassium carbonate or glacial acetic acid. | |

-continued

| Stabilizing solution | |
|---|---|
| 5-chloro-2-methyl-4-isothiazoline-3-one | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide (20% aqueous solution) | 3.0 g |
| Ammonium sulfite | 3.0 g |
| Brightening agent (4,4'-diamino stilbene disulfonate derivative) | 1.5 g |
| Water to make | 1 l |
| pH was adjusted to 7.0 with sulfuric acid or potassium hydroxide | |

All these processed samples having magenta dye images were subjected to the following tests. Light-fastness Test: A color fading rate of the initial density, 1.0, was determined with an under-glass outdoor sunlight exposer after 14 days' exposure to the solar rays.

Color fading rate=(1.0−density after exposure)×100

Also, the spectral reflection was measured on a magenta-colored portion of each sample with a color analyzer Model 607 made by Hitachi Corporation. In the measurement, the maximum density of absorption spectrum of visible region of each sample was set as 1.0. And the difference between a wavelength indicating a density of 0.8 on the short wavelength side and the maximum absorption wavelength (Δλ) was used as the criterion for judging sharpness of color. As the criterion of color, the minimum absorption density ($D_{min}$) at 440–450 nm was used.

Further, the gradation (γ) between 0.8 density and 1.8 density was used as the criterion of color forming property.

The evaluation results are shown in Table 2.

TABLE 2

| Sample No. | Magenta coupler | Antifading agent [II] | Antifading agent [III] | Color fading rate (%) | γ | $D_{min}$ | Δλ (nm) |
|---|---|---|---|---|---|---|---|
| 1 (Comparison) | M-A | — | — | 33 | 3.81 | 0.351 | 36 |
| 2 (Comparison) | M-23 | — | — | 68 | 3.80 | 0.218 | 36 |
| 3 (Comparison) | M-23 | — | III-14 | 36 | 3.04 | 0.218 | 36 |

TABLE 2-continued

| Sample No. | Magenta coupler | Antifading agent [II] | Antifading agent [III] | Color fading rate (%) | γ | $D_{min}$ | Δλ (nm) |
|---|---|---|---|---|---|---|---|
| 4 (Comparison) | M-23 | II-7 | — | 39 | 3.80 | 0.218 | 36 |
| 5 (Invention) | M-23 | II-7 | III-14 | 21 | 3.89 | 0.218 | 34 |
| 6 (Invention) | M-23 | II-14 | III-14 | 18 | 3.87 | 0.218 | 34 |
| 7 (Invention) | M-23 | II-15 | III-14 | 18 | 3.87 | 0.218 | 34 |
| 8 (Invention) | M-23 | II-17 | III-14 | 19 | 3.87 | 0.218 | 34 |
| 9 (Invention) | M-23 | II-4 | III-14 | 22 | 3.86 | 0.218 | 34 |
| 10 (Invention) | M-23 | II-17 | III-1 | 18 | 3.84 | 0.218 | 35 |
| 11 (Invention) | M-23 | II-17 | III-4 | 18 | 3.83 | 0.218 | 35 |
| 12 (Invention) | M-23 | II-17 | III-7 | 22 | 3.82 | 0.218 | 35 |
| 13 (Invention) | M-23 | II-17 | III-8 | 20 | 3.84 | 0.218 | 35 |
| 14 (Invention) | M-23 | II-17 | III-9 | 25 | 3.84 | 0.218 | 35 |
| 15 (Invention) | M-23 | II-17 | III-12 | 18 | 3.85 | 0.218 | 34 |
| 16 (Invention) | M-23 | II-17 | III-13 | 19 | 3.85 | 0.218 | 34 |
| 17 (Comparison) | M-23 | II-7 | Comparison-A | 34 | 3.80 | 0.218 | 35 |
| 18 (Comparison) | M-23 | II-7 | Comparison-B | 66 | 2.09 | 0.218 | 35 |

Comparative compound A:

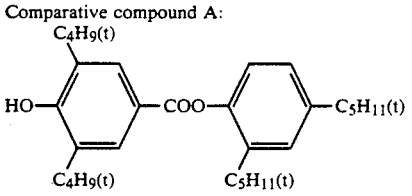

Comparative compound B:

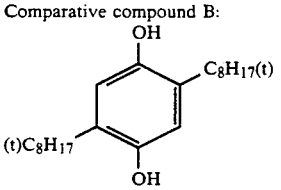

The addition amount of antifading agent was 1 mol per mol of coupler.
The amount of silver added to Samples 2 through 18 was ½ of that added to Sample 1.

As apparent from Table 2, the combination of antifading agents of the invention effectively improved the light-fastedness as compared with non-inventive combinations used in Samples 17 and 18, in addition to unanticipated effects such as no decrease in color forming property and an excellent color tone.

EXAMPLE 2

Samples having the same layer construction as in Example 1 were prepared. In these samples, a blue-sensitive silver chlorobromide emulsion (containing 90 mol % AgBr), green-sensitive silver chlorobromide emulsion (containing 70 mol % AgBr) and red-sensitive silver chlorobromide emulsion (containing 70% AgBr) were used as a silver halide emulsion, and magenta couplers, antifading agents and high boiling solvents were used in the combinations shown in Table 3.

These samples were exposed and processed, and then evaluated in the same manner as in Example 1, except that the following processing conditions were used:

| Processing step | Temperature | Time |
|---|---|---|
| Color developing | 38° C. | 3 min 30 sec |
| Bleach-fixing | 33° C. | 1 min 30 sec |
| Washing | 5-30° C. | 3 min |
| Drying | 75-80° C. | about 2 min |

| Compositions of the processing solutions | |
|---|---|
| Color developing solution | |
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-methyl-4-amino-N-ethyl-N-(β-methanesulfonamide-ethyl)aniline sulfate | 5.5 g |
| Brightening agent (4,4'-diamino stilbene disulfonate derivative) | 1.0 g |
| Potassium hydroxide | 2.0 g |
| Water to make | 1 l |
| pH was adjusted to 10.20. | |
| Bleach-fixing solution | |
| Ammonium ferric ethylenediaminetetraacetate dihydrate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |
| Water to make | 1 l |
| pH was adjusted to 7.1 with potassium carbonate or glacial acetic acid. | |

TABLE 3

| Sample No. | High boiling organic solvent | Magenta coupler | Antifading agent [II] | Antifading agent [III] | Color fading rate (%) | γ | $D_{min}$ | Δλ (nm) |
|---|---|---|---|---|---|---|---|---|
| 19 (Comparison) | DOP | M-A | — | — | 34 | 3.89 | 0.351 | 36 |
| 20 (Comparison) | DOP | M-23 | — | — | 69 | 3.89 | 0.218 | 36 |
| 21 (Comparison) | DOP | M-23 | — | III-14 | 38 | 3.90 | 0.218 | 36 |
| 22 (Comparison) | DOP | M-23 | II-7 | — | 40 | 3.69 | 0.218 | 36 |
| 23 (Invention) | DOP | M-23 | II-7 | III-14 | 21 | 3.94 | 0.218 | 35 |
| 24 (Invention) | DOP | M-23 | II-17 | III-14 | 19 | 3.94 | 0.218 | 35 |

TABLE 3-continued

| Sample No. | High boiling organic solvent | Magenta coupler | Antifading agent [II] | Antifading agent [III] | Color fading rate (%) | γ | $D_{min}$ | Δλ (nm) |
|---|---|---|---|---|---|---|---|---|
| 25 (Invention) | DNP | M-23 | II-17 | III-14 | 18 | 3.95 | 0.218 | 35 |
| 26 (Invention) | DIDP | M-23 | II-17 | III-14 | 17 | 3.95 | 0.218 | 35 |
| 27 (Invention) | DBP | M-23 | II-17 | III-14 | 20 | 3.94 | 0.218 | 35 |
| 28 (Invention) | TCP | M-23 | II-17 | III-14 | 21 | 3.90 | 0.218 | 35 |

DBP: dibutyl phthalate
TCP: tricresyl phosphate

As seen in Table 3, the samples of the invention comprise an improved light-fastness, in addition to advantages in color forming property, color tone and sharpness of images.

EXAMPLE 3

Preparation of Emulsion EM-1

An aqueous solution of silver nitrate and an aqueous solution containing potassium bromide and sodium chloride (KBr/NaCl molar ratio: 40/60) were simultaneously added to an aqueous solution of ossein gelatin by the control double jet method while stirring at 55° C.; thus, Emulsion D containing cubic silver bromochloride grains with an average grain size of 0.3 μm was prepared. Using Emulsion D as core grains, an aqueous solution of silver nitrate and an aqueous solution of sodium chloride were simultaneously added thereto by the double jet method while controlling at 55° C. and pAg 6 to prepare the monodispersed core/shell emulsion EM-1 containing cubic grains with an average grain size of 0.6 μm and a coefficient of variation (S/$\bar{r}$) of 0.08.

On the right side of a paper support coated with polyethylene on both sides (thickness: 220 μm) were formed the 1st layer through the 9th layer described below to prepare Sample P-1 of the color photographic light-sensitive material. In the 1st layer coating-side of the support, there contained titanium white as a white pigment.

Composition of the light-sensitive layers

Components and coating weights thereof (mg/dm$^2$) are shown below. An amount of silver halide is shown in terms of silver.

| | |
|---|---|
| 1st layer: red-sensitive layer | |
| Red-sensitive emulsion prepared by spectrally sensitizing Emulsion EM-1 with red-sensitive sensitizing dyes (RD-1 and RD-2) | 4.0 |
| Gelatin | 13.8 |
| Cyan coupler (C-2) | 2.1 |

-continued

| | |
|---|---|
| Cyan coupler (C-3) | 2.1 |
| Image stabilizer (compound A) | 2.2 |
| Solvent (DBP) | 3.3 |
| 2nd layer: intermediate layer | |
| Gelatin | 7.5 |
| Color mixing inhibitor (compound B) | 0.55 |
| Solvent (DOP) | 0.72 |
| 3rd layer: green-sensitive layer | |
| Green-sensitive emulsion prepared by spectrally sensitizing Emulsion EM-1 with a green-sensitive sensitizing dye (GD-1) | 2.7 |
| Gelatin | 13.0 |
| Magenta coupler (M-1) | 3.5 |
| Solvent (DOP) | 2.0 |
| 4th layer: intermediate layer | |
| The same as 2nd layer. | |
| 5th layer: yellow filter layer | |
| Gelatin | 4.2 |
| Yellow colloidal silver | 1.0 |
| Ultraviolet absorbent (UV-1) | 1.4 |
| Ultraviolet absorbent (UV-2) | 0.5 |
| Color mixing inhibitor (compound B) | 0.4 |
| Solvent (DINP) | 0.8 |
| 6th layer: color mix inhibiting layer | |
| Gelatin | 4.0 |
| Color mixing inhibitor (compound B) | 0.27 |
| Solvent (DOP) | 0.36 |
| 7th layer: blue-sensitive layer | |
| Blue-sensitive emulsion prepared by spectrally sensitizing Emulsion EM-1 with a blue-sensitive sensitizing dye (BD-1) | 5.0 |
| Gelatin | 13.5 |
| Yellow coupler (Y-2) | 8.4 |
| Image stabilizer (compound A) | 3.0 |
| Solvent (DBP) | 5.2 |
| 8th layer: ultraviolet absorbing layer | |
| Gelatin | 5.4 |
| Ultraviolet absorbent (UV-1) | 1.0 |
| Ultraviolet absorbent (UV-2) | 2.8 |
| Solvent (DINP) | 1.2 |
| 9th layer: protective layer | |
| Gelatin | 12.3 |

In coating the above layers, coating aids SA-1 and SA-2 were used, and a hardener HA-1 was added thereto in an amount of 6 mg per gram of gelatin.

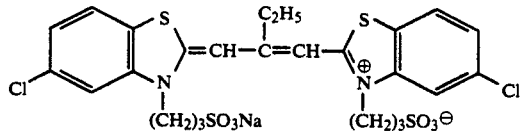

RD-1

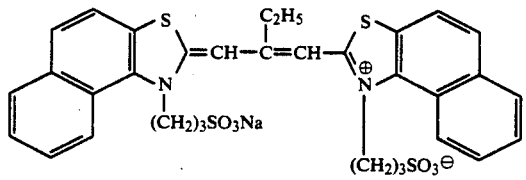

RD-2

-continued

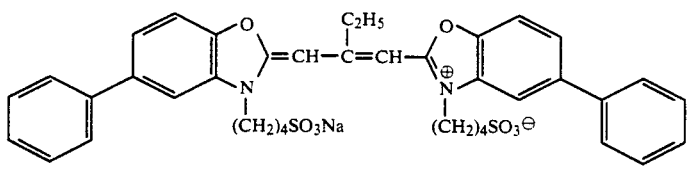

GD-1

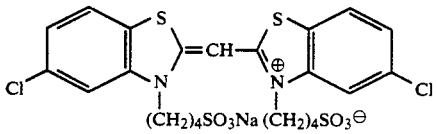

BD-1

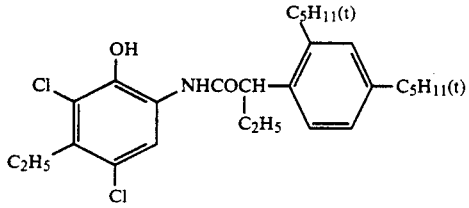

C-3

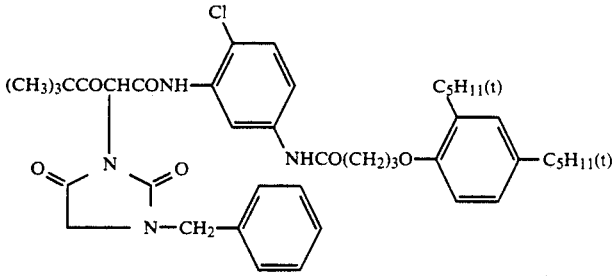

Y-2

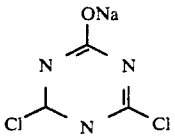

HA-1

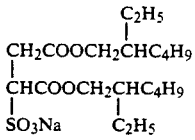

SA-1

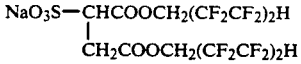

SA-2

Next, there were prepared Samples P-2 to P-11 containing the magenta coupler used in the 3rd layer and dye image stabilizers (anti-fading agents) in combinations shown in Table 4.

Each sample was subjected to a full-sized exposure through a magenta filter followed by an exposure to green light through an optical wedge, and then processed as follows:

| Processing | Time (sec) | Temperature (°C.) |
|---|---|---|
| Dipping | 2 | 38 |
| Exposing | 5 | " (1 lux) |
| Developing | 25 | " |
| Bleach-fixing | 45 | 35 |
| Super stabilizing | 90 | 25-30 |
| Drying | 45 | 75-80 |

-continued

| Compositions of processing solutions | |
|---|---|
| Developer | |
| Benzyl alcohol | 10 g |
| Ethylene glycol | 8.55 g |
| Diethylene glycol | 50 g |
| Sulfate | 0.015 g |
| Potassium sulfite | 2.5 g |
| Sodium bromide | 0.1 g |
| Sodium chloride | 2.5 g |
| Diethyl hydroxylamine (85%) | 5.0 g |
| Sodium diethylene triamine pentacetate | 2.0 g |
| CD-3 | 7.0 g |
| Fluorescent whitening agent (4,4'-diaminostilbene disulfonate derivative) | 1.0 g |
| Potassium carbonate | 30 g |
| Potassium hydroxide | 2.0 g |
| Water to make | 1 l |

pH was adjusted to 10.10 with sodium hydroxide or

-continued

| | |
|---|---|
| sulfuric acid. | |
| Bleach-fixer | |
| Ammonium ferric diethylene triamine pentacetate | 90 g |
| Diethylene triamine pentacetate | 3 g |
| Ammonium thiosulfate (70% solution) | 180 ml |
| Ammonium sulfite (40% solution) | 27.5 ml |
| 3-mercapto-1,2,4-triazole | 0.15 g |
| Water to make | 1 l |
| pH was adjusted to 7.1 with potassium carbonate or glacial acetic acid. | |
| Stabilizer | |
| O-phenyl phenol | 0.3 g |
| Potassium sulfite (50% solution) | 12 ml |
| Ethylene glycol | 10 g |
| 1-hydroxyethylidene-1,1-diphosphonic acid | 2.5 g |
| Bismuth chloride | 0.2 g |
| Zinc sulfate heptahydrate | 0.7 g |
| Ammonium hydroxide (28% aqueous solution) | 2.0 g |
| Polyvinylpyrrolidone (K-17) | 0.2 g |
| Fluorescent whitening agent (4,4'-diaminostilbenedisulfonate derivative) | 2 g |
| Water to make | 1 l |
| pH was adjusted to 7.5 with sodium hydroxide or sulfuric acid. | |

Stabilizing was carried out by a two-bath counter-flow method.

Processed samples were preserved for one week under illumination of a xenon lamp. Then, the changes in dye density of yellow, magenta and cyan were measured with a spectral reflection densitometer Model PDA-65 made by Konica Corporation. The results are shown in Table 4.

After processing, all magenta-image-carrying samples were subjected to light-fastness test in the same manner as in Example 1 to evaluate the color fading rate. At the same time, the color tone was visually examined and graded with A: fine, and B: not fine. The results are also shown in Table 4.

TABLE 4

| Sample No. | Magenta coupler | Anti-fading agent [II] | Anti-fading agent [III] | Color fading rate (%) | Color tone |
|---|---|---|---|---|---|
| P-1 (Comparison) | M-1 | — | — | 35 | B |
| P-2 (Comparison) | I-23 | — | — | 70 | A |
| P-3 (Comparison) | I-23 | — | III-14 | 36 | A |
| P-4 (Comparison) | I-23 | II-7 | — | 40 | A |
| P-5 (Invention) | I-23 | II-7 | III-14 | 22 | A |
| P-6 (Invention) | I-23 | II-14 | III-14 | 20 | A |
| P-7 (Invention) | I-23 | II-17 | III-14 | 19 | A |
| P-8 (Invention) | I-23 | II-17 | III-1 | 19 | A |
| P-9 (Invention) | I-23 | II-17 | III-12 | 20 | A |
| P-10 (Comparison) | I-23 | II-7 | compound A | 35 | A |
| P-11 (Comparison) | I-23 | II-7 | compound B | 66 | A |

Notes:
Comparative compounds A and B are the same as in Example 1.
The addition amount of the anti-fading agent was 1.1 mol per mol of coupler.
The coating amount of silver in P-2 to P-11 was ½ of that in P-1.

It is understood from Table 4 that, in the direct positive light-sensitive material of internal latent image type, the combination of anti-fading agents according to the invention has a large effect of improving light-fastness which cannot be achieved by conventional combinations.

EXAMPLE 4

Samples P-10 to P-14 (I-46) and P-15 to P-19 (I-61) were prepared in the same manner as in Example 3, except that the magenta coupler, I-23 used in Samples P-5 to P-9 was replaced with I-46 and I-61 respectively.

Each sample was processed and evaluated in the same way as in Example 3, the results were also excellent.

What is claimed is:

1. A silver halide color photographic light-sensitive material comprising a support having thereon a silver halide emulsion layer containing at least one compound of Formula [I], at least one compound of Formula [IIA] or [IIB], and at least one compound of Formula [IIIB]:

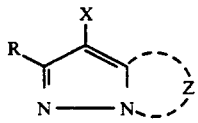

General Formula [I]

wherein Z represents a group of non-metallic atoms necessary to form a nitrogen-containing heterocycle which may contain a substituent; X represents hydrogen or a group capable of being split off upon reaction with an oxidation product of a developing agent; and R represents hydrogen or a substituent;

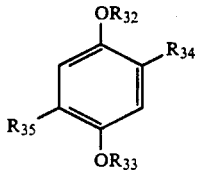

[IIA]

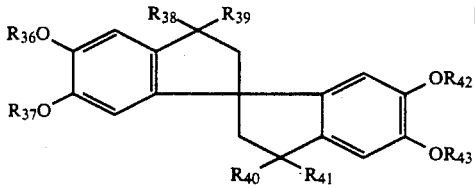

[IIB]

wherein $R_{32}$ through $R_{43}$ independently represent alkyl;

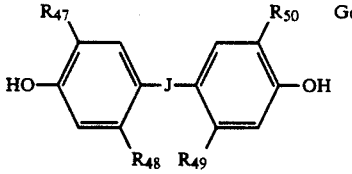

General Formula IIIB wherein $R_{47}$, $R_{48}$, $R_{49}$ and $R_{50}$ independently represent alkyl, and J represents alkylene which may have a branched chain.

2. A silver halide color photographic light-sensitive material of claim 1, wherein the compound represented by General Formula [I] is represented by the following formula:

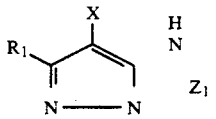

wherein $R_1$, X and $Z_1$ are the same as those defined for R, X and Z in General Formula [I].

3. A silver halide color photographic light-sensitive material of claim 1, wherein the compound represented by General Formula [I] is represented by either of the following formulas:

[I A]

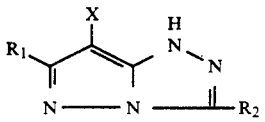

[I B]

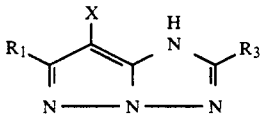

[I C]

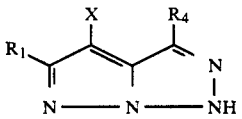

[I D]

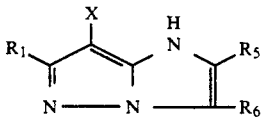

-continued

[I E]

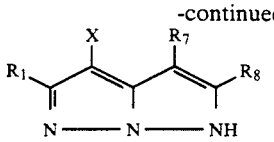

[I F]

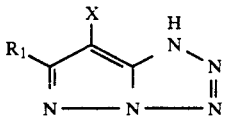

wherein $R_1$ through $R_8$ and X are the same as those defined for R and X in General Formula [I] respectively.

4. A silver halide color photographic light-sensitive material of claim 3, wherein $R_1$ is represented by the following formula:

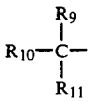

wherein $R_9$, $R_{10}$ and $R_{11}$ are the same as those defined for R in General Formula [I].

5. A silver halide color photographic light-sensitive material of claim 4, wherein two of $R_9$, $R_{10}$ and $R_{11}$ are alkyl groups, and the remaning one is a hydrogen atom or an alkyl group.

6. A silver halide color photographic light-sensitive material of claim 3, wherein $R_2$, $R_3$, $R_4$, $R_5$, $R_6$, $R_7$ or $R_8$ is $$-R_{12}-SO_2-R_{13}$$

wherein $R_{12}$ represents an alkylene group and $R_{13}$ represents an alkyl group, an cycloalkyl group or an aryl group.

7. A silver halide color photographic light-sensitive material of claim 1, wherein both $R_{32}$ and $R_{33}$ are alkyl group having five or less carbon atoms.

* * * * *